United States Patent [19]

Esmonde et al.

[11] 4,198,012

[45] Apr. 15, 1980

[54] COLLAPSIBLE REEL

[75] Inventors: Roderic A. Esmonde, Macungie, Pa.; Frederick W. DeBellis, Piscataway, N.J.

[73] Assignee: Bethlehem Fabricators, Inc., Bethlehem, Pa.

[21] Appl. No.: 894,552

[22] Filed: Apr. 10, 1978

[51] Int. Cl.[2] ..... B65H 75/22; B65H 75/14

[52] U.S. Cl. ..... 242/115

[58] Field of Search ..... 242/115, 110.1, 110, 242/110.2, 118.2, 110.3

[56] References Cited

U.S. PATENT DOCUMENTS

| | | | |
|---|---|---|---|
| 1,913,477 | 6/1933 | Daubmeyer et al. | 242/115 |

FOREIGN PATENT DOCUMENTS

| | | | |
|---|---|---|---|
| 559625 | 9/1932 | Fed. Rep. of Germany | 242/115 |
| 467787 | 6/1937 | United Kingdom | 242/115 |
| 589990 | 7/1947 | United Kingdom | 242/115 |

*Primary Examiner*—George F. Mautz

*Attorney, Agent, or Firm*—Eugene Chovanes; Edward Lovett Jackson

[57] ABSTRACT

A metal reel for cable wire or the like having a cylindrical drum which can collapse longitudinally whereby the reel can be substantially reduced in width, when empty, for economy of space in shipment or storage.

15 Claims, 15 Drawing Figures

COLLAPSIBLE REEL

BACKGROUND OF THE INVENTION

Metal reels are used extensively to ship cable, wire rope, or the like from a manufacturing plant to a point of use. Such reels consist essentially of a cylindrical drum portion upon which the cable is wound, and flanges extending radially at the ends of the drum. The reels are of a substantial size and weight. For instance, the outside diameter of the flange may be in the range of 42" to 108", the drum itself may be in the range of 24" to 56" in diameter, and the reel may have a width in the range of 24" to 74". The reel may weigh in excess of 2000 lbs.

The reels are intended to be reused over and over. The drums are shipped wound with cable and then returned empty.

Efforts have been made to reduce the size of the empty reel to conserve space in shipment or storage by collapsing the reel, as shown for instance in U.S. Pat. Nos. 1,913,477, 2,099,102 and 3,791,606. Reels of this type have folding bars extending between the flanges.

SUMMARY OF THE PRESENT INVENTION

In the collapsible reel of the present invention, a cylindrical drum extending between the flanges collapses longitudinally to reduce the width of the empty reel. In expanded condition, the surface of the drum, which is formed of specially shaped drum segments, provides a cylindrical surface for the cable support. The drum segments are supported by pivoting members which permit the drum segments to interfold with one another in the collapsed position. The segments have arcuate curves thereon which permit such folding. The arcuate cuts on the segments are of the same radius as the expanded drum.

In the collapsed position, the reel is reduced to up to $\frac{1}{3}$ of its expanded width, thus permitting economy of space in shipment or storage.

The collapsible reel of the invention may be obtained by reworking the continuous surface cylindrical drum of an existing conventional rigid reel or the reel may be made completely as an original fabrication.

DESCRIPTION OF THE PREFERRED EMBODIMENT

Figure 1:
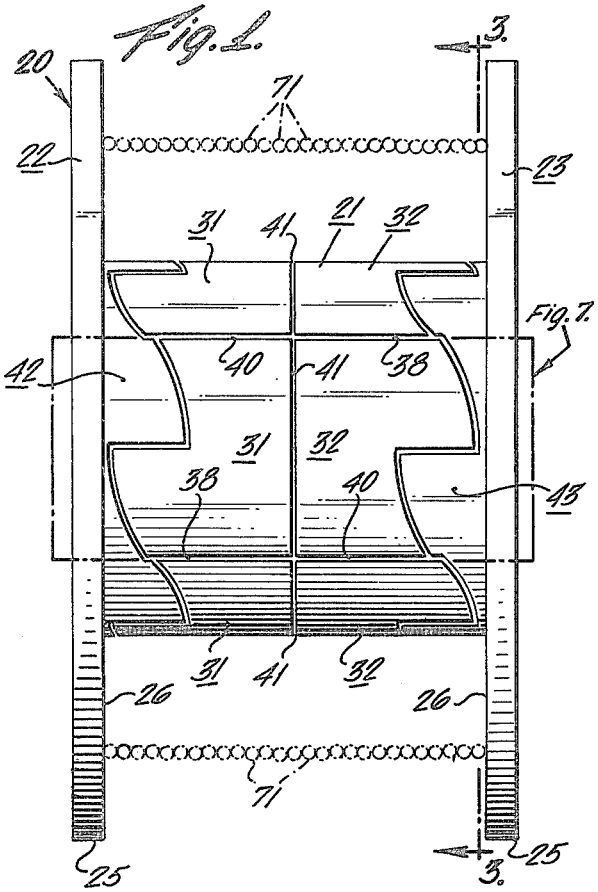
FIG. 1 is a side elevation of the reel of the invention.

Shown in FIG. 1 is a metal reel 20 having a drum 21, and flange assemblies 22 and 23. Each of the flange assemblies has a tire or rim 25, a head sheet 26 and inner ring 27 and cross brace 28. Positioned within the cross brace 28 is bushing 30. Rigid reels of this general form are well known in the prior art.

Figure 4:
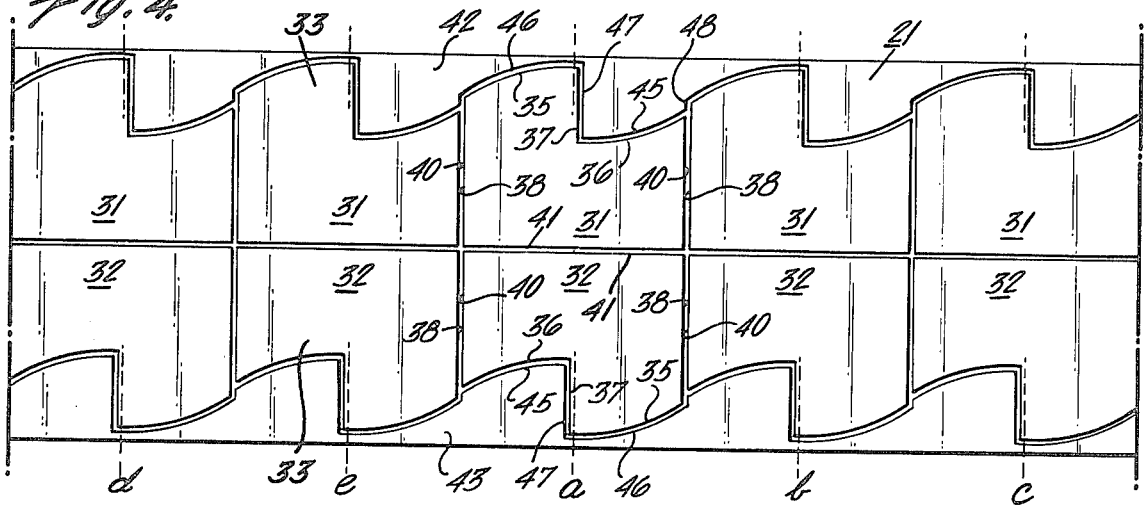
FIG. 4 is a development of the reel drum portion indicating the cutting operation thereon.

In the present invention the drum 21 is composed of segments which can be best understood in reference to FIG. 4 wherein the drum is developed or expanded to its full circumference for explanation purposes. It should be understood that in the actual construction of the collapsible reel of the invention the plane of the drum surface is arcuate. As seen in FIG. 4 a plurality of segments 31 and 32 extend circumferentially about the drum surface. These segments are identical to one another, and include arcuate surface 33 and curves 35 and 36. The radius of curves 35 and 36 are identical to one another and equal to the radius of outer surface of drum 21. Curves 35 and 36 are connected by a straight line cut 37. Each of the segments 31 and 32 additionally are bounded by straight cuts 38 and 40 opposite one another and straight cut 41. The straight cut 41 on segment 31 is positioned adjacent straight cut 41 on segment 32.

Figure 5:
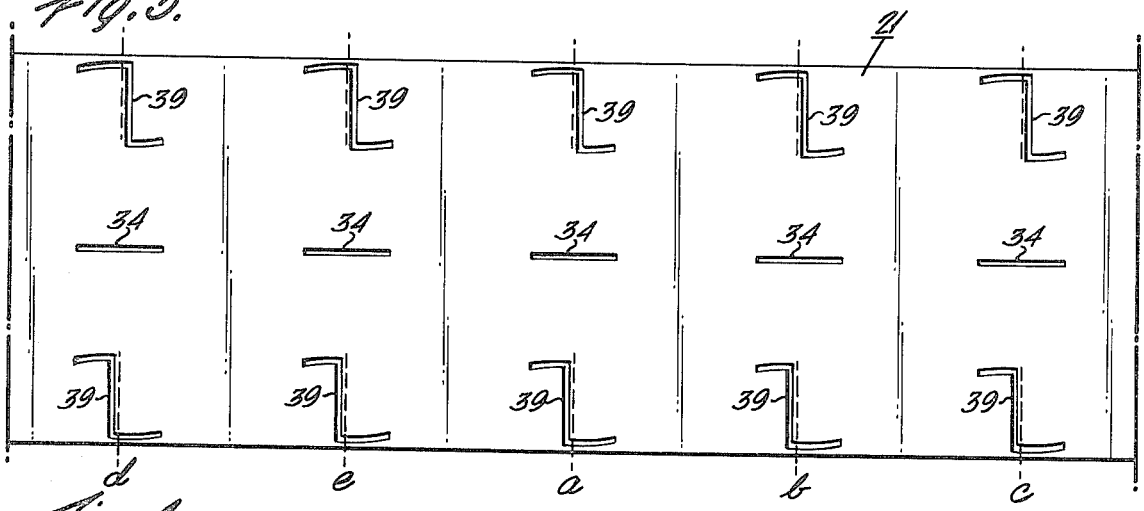
FIG. 5 is a development of the drum portion of the reel of FIG. 1 showing preliminary cutting operation.

In the actual construction of the drum, either from an existing reel, or in an original fabrication, partial cuts are first made in the drum 21 surface as shown in FIG. 5. Reference is made to equally spaced circumferential points "a" to "e," which are also identified on other figures. Short cuts 34 and 39, as by burning with a torch, are made as shown, with the intent that the cuts will be continued to the extent shown in FIG. 4. Suitable supporting structure, as later explained, will be attached to the drum prior to the completed cutting as shown in FIG. 4.

The drum surface also has thereon portions 42 and 43 which are suitably secured as by welding to the inner rings 27 which in turn are welded to head sheets 26 of the flange assemblies 22 and 23 respectively. Segments 42 and 43 have curved portions 45 and 46 which are of the same radius as curves 35 and 36, namely equal to the radius of the drum 21. Curves 45 and 36 are complementary and juxtaposed, and curves 35 and 46 are complimentary and juxtaposed when the reel is in the expanded position as shown in FIG. 1.

Segments 42 and 43 have thereon straight portions 47 which when the reel is in expanded position is adjacent to portion 37 on segments 31 and 32. Portions 42 and 43 also have a straight portion 48 which extends partially along edge 40 of the segments 31 and 32, when the reel is in expanded position.

The segments 31 and 32 are repetitive around the circumference of the drum and in the embodiment shown are repeated five times, each of the segments occupying 1/5 of the circumference of drum 21. Other numbers of segments may be used providing the circumference is divided into equal portions.

Figure 7:
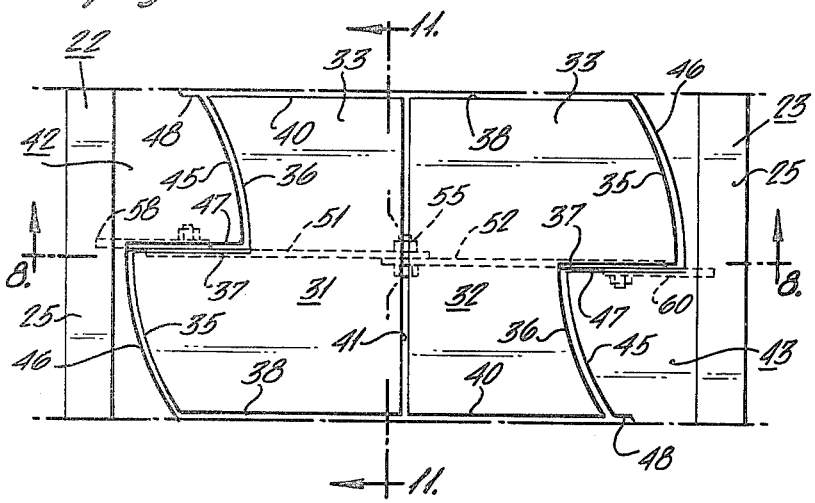
FIG. 7 is an enlarged fragmentary detail of the area shown in FIG. 1.
Figure 11:
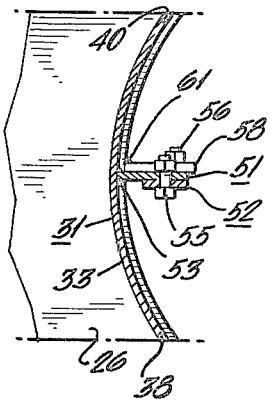
FIG. 11 is a transverse section taken on the line 11—11 of FIG. 7.

The segments 31 and 32 as best seen in FIG. 7 are supported by support arms 51 and 52 which extend longitudinally within drum 21 and which are secured to the respective segments by for instance welding at 53. Arms 51 and 52 are pivoted to each other by suitable pin 55. The arms 51 and 52 are pivoted at their outside ends at 56 and 57 to plates 58 and 60 respectively which are secured by welding or the like at 61, to the inner rings 27, 27 which are in turn welded to drum portions 42 and 43. Locking blocks (or stop members) 63 are suitably fixed to the support members 51 and 52 adjacent a vertical end wall 70 above the pivot point 55. The stop members 63 have mounted thereon rectangular retaining strips 65 having an outwardly flared guide extension 68.

The reel is shipped in an expanded condition as seen in FIG. 1. The drum 21 is fully cylindrical and segments 42, 31, 32, and 43 all lie in the curved plane of the drum surface. Flange assemblies 22 and 23 are expanded from one another as far as possible. In this position support arms 51 and 52 are in the position shown in FIG. 8 wherein they are in a direct relationship to one another. The vertical end wall 70 of arm 51 is in abutting relationship with the stop 63 mounted on arm 52 and the vertical end wall 70 of arm 52 is in abutting relationship with the stop 63 mounted on the arm 51. The retaining strip 65 insures correct alignment of stop blocks and arm members. This arrangement prevents arms 51 and 52 from collapsing radially inwards. Arms 51 and 52 at their outward ends are secured through pivots 56 and 57 to plates 58 and 60, thus forming a rigid connection between opposing flange assemblies 22 and 23.

Figure 3:
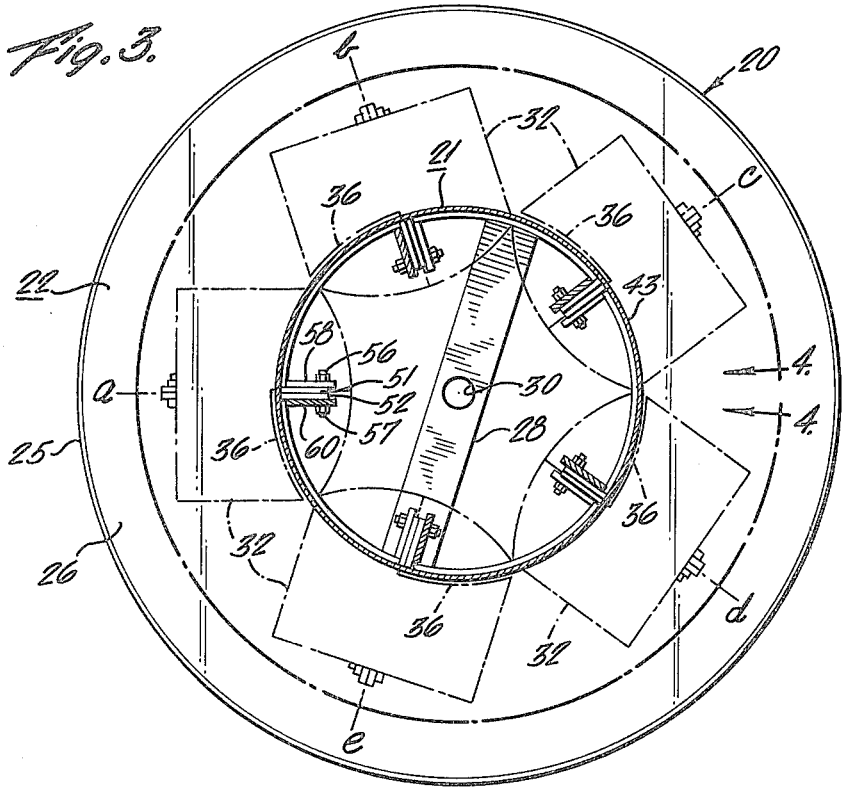
FIG. 3 is a transverse sectional elevation of the reel shown in FIG. 1 with the panels shown in dotted lines showing a folded position such as in FIG. 2.

Connecting arms 51 and 52 are spaced circumferentially around the inner drum surface 21 as seen in FIG. 3. When the reel is in the expanded position described, cable 71 shown in phantom in FIG. 1 is circumferentially wrapped about drum 21 and is retained thereon by flange assemblies 22 and 23 as seen in FIG. 1. Drum 21 in this expanded position is cylindrical and in this embodiment substantially continuous and functions in effect the same as prior art drums and reels.

Figure 2:
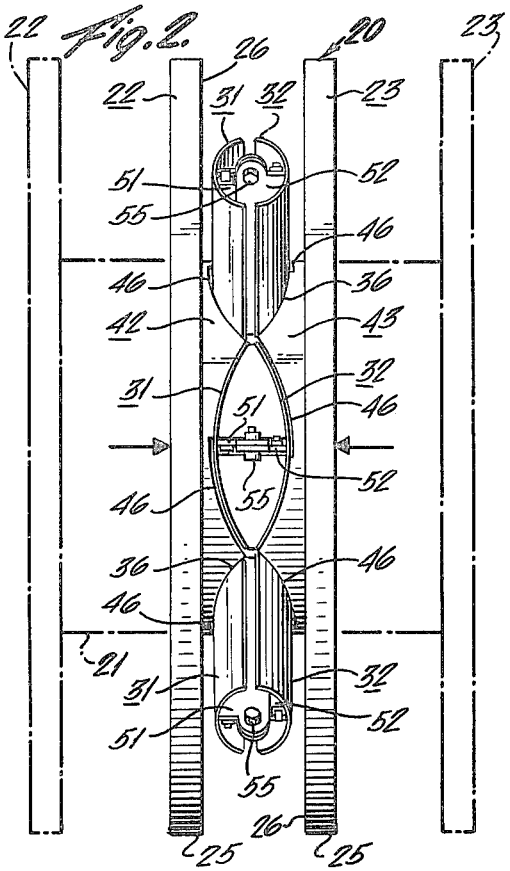
FIG. 2 is a side elevation showing the collapsed or folded state of the reel shown in FIG. 1 with the expanded reel shown in phantom.

After the reel is shipped to the job site, and the cable is unwound, the reel is collapsed into the position best seen in FIG. 2.

Figure 8:
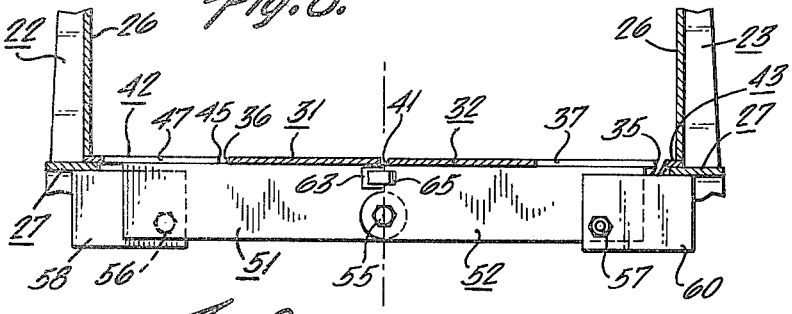
FIG. 8 is a transverse sectional view taken on the line 8—8 of FIG. 7.
Figure 13:
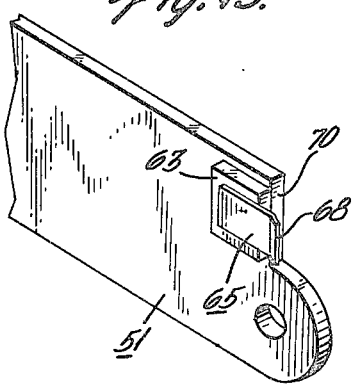
FIG. 13 is a fragmentary pictorial view showing details of one of the pivotal panel supports.
Figure 9:
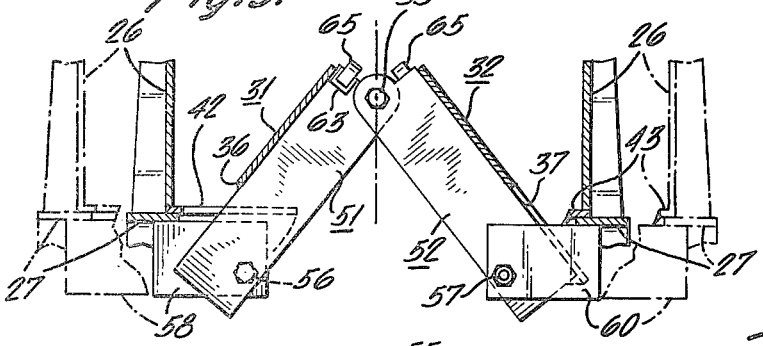
FIG. 9 is a view similar to FIG. 8 showing the reel collapsing at an intermediate point of closure.
Figure 10:
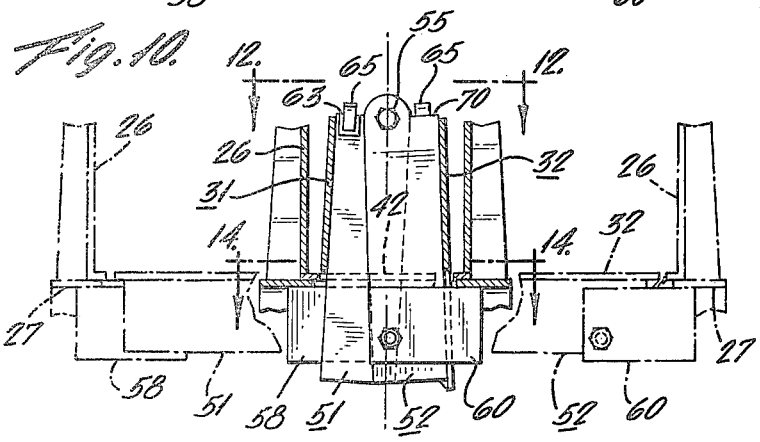
FIG. 10 is a view similar to FIG. 8 showing the reel just before it reaches its fully collapsed position.
Figure 12:
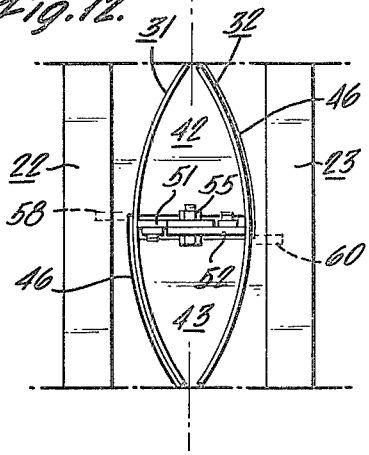
FIG. 12 is a fragmentary plan view of the folded panels shown in FIG. 10.
Figure 15:
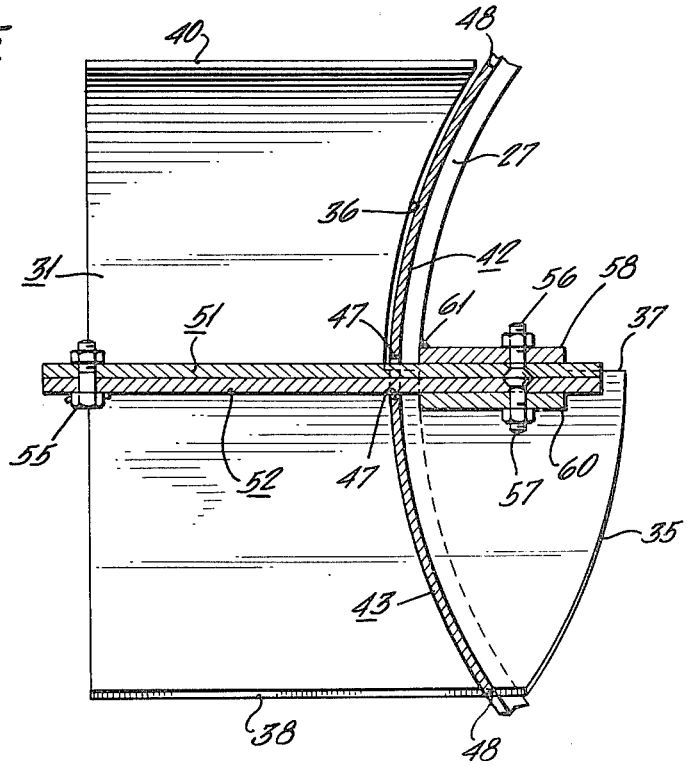
FIG. 15 is a sectional view taken on the line 15—15 of FIG. 14 showing details of the panel structure when the reel is in its collapsed position.

When the support arms 51 and 52 are in the extended, in-line position as seen in FIG. 8, pivot 55 is slightly radially further outward on the reel than are pivots 56 and 57, for instance ½". When longitudinally inward forces are applied on the flange portions 42 and 43 of the empty reel, forcing the flanges one toward the other, desirably along the axis of the reel at bearing 30, this slight offset permits the arms 51 and 52 to begin folding as shown in FIG. 9. As further seen in FIG. 9, the flange assemblies 22 and 23 and drum segments 42 and 43 begin to move toward one another from the phantom position shown. The flanges 22 and 23 are further forced toward one another until the reel is in the fully collapsed position. There is an overlapping at this point of support plates 58 and 60, but no interference because pivots 56 and 57 are countersunk as shown in FIG. 15 so as to be flush with the surfaces of the overlapping plates 58 and 60.

Figure 14:
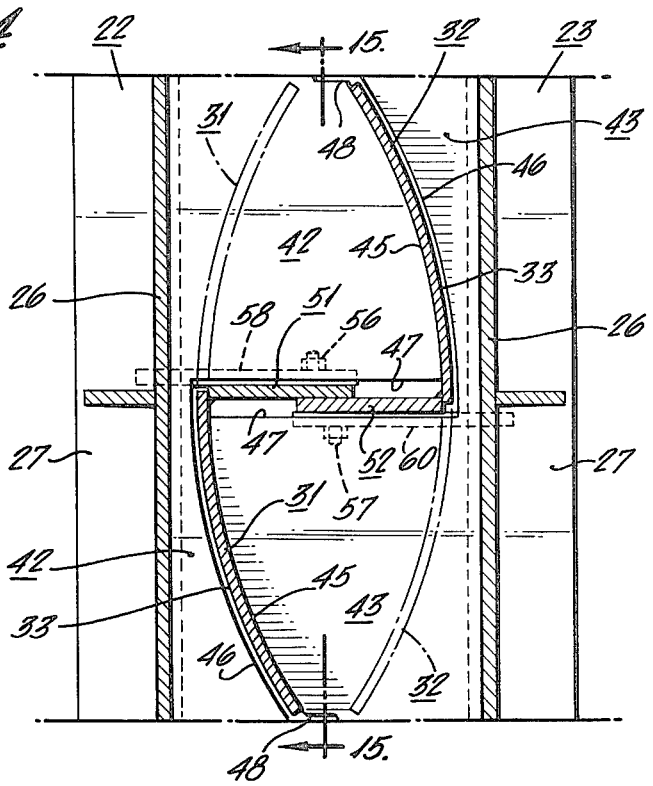
FIG. 14 is a sectional plan view taken on the line 14—14 of FIG. 10 showing the interlocking of drum portions of the reel.

In the collapsed position arc 46 of drum segment 42 has extending adjacent thereto folded drum segment 31 as best seen in FIG. 14. The curvature of the cylindrical surface of segment 31 conforms to arc 46, eliminating any interference and permitting full collapse. Similarly arcuate curve 36 of segment 31 conforms to the cylindrical curved surface of segment 42, as seen in FIG. 15.

Figure 6:
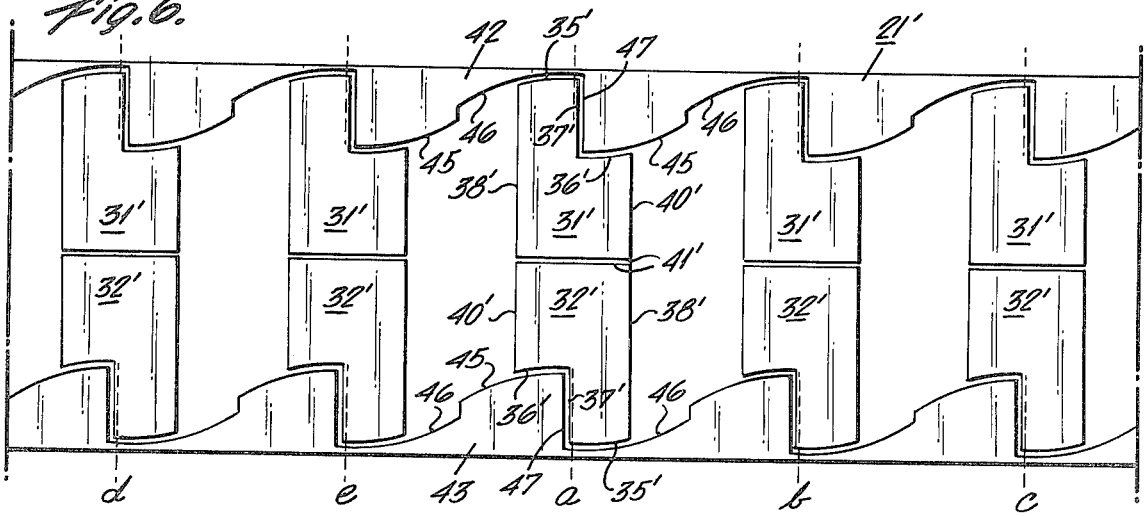
FIG. 6 is a development showing a modified form of cutting the drum eliminating a portion of the drum sheet.

FIG. 6 shows a modified development of the drum portion 21'. In this instance, the segments 31' and 32' are reduced in their circumferential span, to create voids on the surface of drum 21'. The segments 31' and 32' continue to have the same radius of curvature on 35' and 36' as the radius of drum 21'.

In use, cable is wrapped on the expanded reel to a suitable diameter as shown for instance in FIG. 1, wherein the outer layer of cable 71 is shown in phantom. Drum 21 is in the shape of a right circular cylinder and is held in a fixed position under the influence of the wrap of the cable.

As seen in FIG. 8, arms 51 and 52 are held in an aligned position with ends 70 of the arms abutting against stop 63 on the opposing arm. Locking stop 63 along with guide 65 keeps the ends 70 of the arms in such abutting relationship. Segments 31 and 32, and portions 42 and 43 all match to form a substantially continuous surface cylindrical drum, with no portions overlapping. The segments are supported from arm 51 and 52 as described above.

After the cable 71 is removed from the reel, and the reel is ready for storage or shipment, the reel is collapsed by forcing flanges 22 and 23 toward one another, as for instance by laying the reel flat on one of the flanges and pressing down on the upper flange. Since pivot 55 is slightly radially outward from the pivots 56 and 57 when the reel is expanded, as seen in FIG. 8, pivot 55 will move radially outward, as seen in FIG. 9, under the influence of a collapsing force. When the reel is almost fully collapsed, it will appear as best seen in FIGS. 2, 10, 12, 14 and 15. Segments 31 and 32 will fold so that curves 36 will conform to cylindrical surfaces 42 and 43 as best seen in FIG. 15. Also, curves 46 will conform to arcuate surfaces 33 of segments 31 and 32 as best seen in FIG. 14. There will be no interference of the drum segment during the collapsing as described above in view of the particular shape and movement of the drum segments 31 and 32, and supporting arms 51 and 52, as described.

The reel expands by forcing the flanges 22 and 23 apart from one another. The movement described above for the collapsing action will be reversed.

In an alternative embodiment, cut 41 may be formed in other than a straight line as for instance in a slight S curve, or blank portions may be provided in the drum surface between sides 38' and 40' as seen in FIG. 6, and described earlier. Of course curves 35' and 36' are still of a radius equal to the radius of the drum 21', and the structure and operation of the reel is the same as that described in the main embodiment. The expanded reel utilizing the embodiment of FIG. 6 will have spaces disposed circumferentially in the drum surface which will be bridged by the wrapped-on cable.

In view of our invention and disclosure, variations and modifications to meet individual whim or particular need will doubtless become evident to others skilled in the art, to obtain all or part of the benefits of our invention without copying the structure shown, and we therefore claim all such insofar as they fall within the reasonable spirit and scope of our claims.

Having thus described our invention, what we claim as new and desire to secure by Letters Patent is:

1. A collapsible reel having an expanded and a collapsed position and comprising a pair of end flanges spaced one from another, a segmented cylindrical drum extending between the flanges having some segments between the flanges fixed in position on the flanges and other segments between the flanges movable relative to the flanges, and means connecting the movable segments to each other and to the fixed segments, wherein the fixed and movable segments are shaped so the movable segments can fold relative to the fixed segments when the reel is collapsed.

2. The reel of claim 1 wherein the drum is a right circular cylinder.

3. The reel of claim 1 wherein each of the segments has a portion of a side of its perimeter curved in an arc.

4. The reel of claim 3 wherein the radius of curvature of the arc is equal to the radius of curvature of the drum.

5. The reel of claim 3 wherein the connecting means permits the drum to collapse longitudinally.

6. The reel of claim 5 wherein the said arc portion lies adjacent to, and conforms with, the surface of an adjacent drum segment, when the drum collapses longitudinally.

7. The reel of claim 1 wherein some of the segments are hingedly connected by means of pivotally connected arms.

8. The reel of claim 7 wherein the arms have means for locking when the reel is in an expanded position.

9. A collapsible reel having an expanded and a collapsed portion and comprising a pair of end flanges spaced one from another, and a drum extending between and connected to the end flanges and having a cylindrical surface formed of segments with means supporting and connecting the segments whereby the reel can be expanded to receive cable thereon, and the reel can be collapsed when empty, some segments of the drum being fixed on the flanges, and other segments of the drum being pivoted relative to the fixed segments, and foldable relative to the fixed segments when the reel is collapsed, said fixed and foldable segments forming a surface for winding material thereon.

10. A collapsible reel comprising a pair of flanges spaced apart, a drum formed of segments extending between and connected to the flanges having a cylindrical surface formed of some segments fixed to the flanges and other segments foldable relative to the fixed segments, and means connecting the movable segments to each other and to the fixed segments, wherein each segment is of a shape whereby in an expanded position, the drum surface of the reel forms a right circular cylinder, and in a collapsed position, the foldable segments are folded with respect to the fixed segments.

11. The reel of claim 10 wherein the connecting means permits the drum to collapse longitudinally.

12. The reel of claim 10 wherein the foldable segments are spaced apart, whereby the drum, in an expanded position, has spaces in the surface.

13. In a collapsible reel for cable and the like, having a pair of flanges spaced one from another and a cylindrical drum extending between and connected to the flanges, folding segments forming a portion of the drum, segments fixed to the flanges forming the remainder of the drum, and means connecting the movable segments to each other and to the fixed segments, wherein the boundaries between fixed and folding segments include arcs which permit the segments to fold with respect to one another when the reel is collapsed.

14. A reel of claim 13 wherein the connecting means permits the drum to collapse longitudinally.

15. In the reel of claim 13, said folding segments being spaced apart to provide the drum with spaces.

* * * * *